US012281440B2

(12) United States Patent
Postl et al.

(10) Patent No.: US 12,281,440 B2
(45) Date of Patent: Apr. 22, 2025

(54) ENDLESS WOVEN DRYER FABRIC FOR PAPERMAKING MACHINE

(71) Applicant: Huyck Licensco Inc., Youngsville, NC (US)

(72) Inventors: Friedrich Postl, Flatz (AT); Klaus Haiden, Neunkirchen (AT)

(73) Assignee: Huyck Licensco Inc., Youngsville, NC (US)

( * ) Notice: Subject to any disclaimer, the term of this patent is extended or adjusted under 35 U.S.C. 154(b) by 47 days.

(21) Appl. No.: 17/532,440

(22) Filed: Nov. 22, 2021

(65) Prior Publication Data

US 2022/0186439 A1 Jun. 16, 2022

Related U.S. Application Data

(60) Provisional application No. 63/126,166, filed on Dec. 16, 2020.

(51) Int. Cl.
*D21F 7/12* (2006.01)
*D03D 1/00* (2006.01)
(Continued)

(52) U.S. Cl.
CPC ..... *D21F 7/12* (2013.01); *D03D 1/0094* (2013.01); *D03D 3/04* (2013.01); *D03D 13/004* (2013.01);
(Continued)

(58) Field of Classification Search
CPC . D21F 7/10; D21F 7/12; D21F 1/0045; D21F 7/083; D21F 1/0054; D03D 1/0094;
(Continued)

(56) References Cited

U.S. PATENT DOCUMENTS 3,815,645 A * 6/1974 Codorniu ..... D21F 1/0036 139/408
4,896,702 A * 1/1990 Crook ..... D21F 7/10 24/31 H
(Continued)

FOREIGN PATENT DOCUMENTS

EP 1736595 A1 12/2006
JP 2000514884 A 11/2000
(Continued)

OTHER PUBLICATIONS

"International Search Report and Written Opinion corresponding to International Application No. PCT/US2021/061328 mailed Mar. 29, 2022".
(Continued)

*Primary Examiner* — Jacob T Minskey
*Assistant Examiner* — Matthew M Eslami
(74) *Attorney, Agent, or Firm* — Myers Bigel, P.A.

(57) ABSTRACT

An endless-woven dryer fabric for a papermaking machine includes: a plurality of upper warp yarns; a plurality of lower warp yarns; and a plurality of weft yarns interwoven with the plurality of upper and lower warp yarns in a series of repeat units. Each weft yarn includes upper and lower portions, the upper portions interwoven with the upper warp yarns, and the lower portions interwoven with the lower warp yarns. The upper portion of each weft yarn includes a first seam loop and the lower portion of each weft yarn includes a second seam loop. The first and second seam loops of the weft yarns are interdigitated to form a seam, the seam receiving a pintle so that the fabric forms an endless loop.

11 Claims, 3 Drawing Sheets

(51) Int. Cl.

| | |
|---|---|
| ***D03D 3/04*** | (2006.01) |
| ***D03D 13/00*** | (2006.01) |
| ***D21F 1/00*** | (2006.01) |
| ***D21F 7/08*** | (2006.01) |

(52) U.S. Cl.
CPC ..... *D21F 1/0045* (2013.01); *D21F 7/083* (2013.01); *D10B 2331/04* (2013.01); *D10B 2331/301* (2013.01); *D10B 2505/00* (2013.01)

(58) Field of Classification Search
CPC ..... D03D 3/04; D03D 13/004; D03D 11/02; D03D 15/283; D03D 15/292; D10B 2505/00
USPC ..... 162/902, 904
See application file for complete search history.

(56) References Cited

U.S. PATENT DOCUMENTS

| | | | | | |
|---|---|---|---|---|---|
| 4,972,561 | A * | 11/1990 | Aldrich | D21F 7/10 | 28/142 |
| 5,169,499 | A | 12/1992 | Eagles et al. | | |
| 5,791,383 | A | 8/1998 | Eckhardt | | |
| 6,000,441 | A * | 12/1999 | Lee | D21F 7/10 | 162/904 |
| 7,455,078 | B2 * | 11/2008 | Swaine | D21F 7/083 | 162/902 |
| 8,241,465 | B2 * | 8/2012 | Crook | D21F 7/10 | 162/900 |
| 2016/0145799 | A1 * | 5/2016 | Alias | D21F 7/10 | 162/358.2 |
| 2017/0037573 | A1 | 2/2017 | Postl | | |

FOREIGN PATENT DOCUMENTS

| | | | |
|---|---|---|---|
| JP | 2002194690 | A | 7/2002 |
| JP | 2010540794 | A | 12/2010 |
| WO | 9851846 | A1 | 11/1998 |
| WO | 2009046017 | A1 | 4/2009 |
| WO | 2009106184 | A1 | 9/2009 |

OTHER PUBLICATIONS

"International Preliminary Report on Patentability corresponding to International Application No. PCT/US2021/061328 issued Jun. 29, 2023".

"MasterDry premium dryer fabric technology for every machine and position [retrieved from internet on Jul. 25, 2024]", https://web.archive.org/web/20200926063818/https://www.andritz.com/pulp-and-paper-en/globalservices/paper-mill-services-/andritz-fabrics-and-rolls/dryer-fabrics> published on Sep. 26, 2020 as per Wayback Machine [3].

"Office Action corresponding to Australian Application No. 2021402831 dated Jul. 25, 2024".

"Office Action corresponding to Brazilian Application No. BR112023008684-1 dated Jul. 24, 2024".

"Office Action corresponding to Canadian Application No. 3,199,470 issued Sep. 19, 2024".

"Extended European Search Report corresponding to European Application No. 21907442.4 dated Oct. 18, 2024".

* cited by examiner

ENDLESS WOVEN DRYER FABRIC FOR PAPERMAKING MACHINE

RELATED APPLICATION

The present application claims priority from and the benefit of U.S. Provisional Patent Application No. 63/126,166, filed Dec. 16, 2020, the disclosure of which is hereby incorporated herein by reference in its entirety.

FIELD

The present invention relates generally to papermaking, and more particularly to fabrics employed in papermaking.

BACKGROUND

In the conventional fourdrinier papermaking process, a water slurry, or suspension, of cellulosic fibers (known as the paper "stock") is fed onto the top of the upper run of an endless belt of woven wire and/or synthetic material that travels between two or more rolls. The belt, often referred to as a "forming fabric," provides a papermaking surface on the upper surface of its upper run that operates as a filter to separate the cellulosic fibers of the paper stock from the aqueous medium, thereby forming a wet paper web. The aqueous medium drains through mesh openings of the forming fabric, known as drainage holes, by gravity or vacuum located on the lower surface of the upper run (i.e., the "machine side") of the fabric.

After leaving the forming section, the paper web is transferred to a press section of the paper machine, where it is passed through the nips of one or more pairs of pressure rolls covered with another fabric, typically referred to as a "press felt." Pressure from the rolls removes additional moisture from the web; the moisture removal is enhanced by the presence of a "batt" layer of the press felt. The paper is then transferred to a dryer section (which utilizes a dryer fabric) for further moisture removal. After drying, the paper is ready for secondary processing and packaging.

As used herein, the terms machine direction ("MD") and cross machine direction ("CMD") refer, respectively, to a direction aligned with the direction of travel of the papermakers' fabric on the papermaking machine, and a direction parallel to the fabric surface and traverse to the direction of travel. Likewise, directional references to the vertical relationship of the yarns in the fabric (e.g., above, below, top, bottom, beneath, etc.) assume that the papermaking surface of the fabric is the top of the fabric and the machine side surface of the fabric is the bottom of the fabric.

Typically, papermaker's fabrics are manufactured as endless belts by one of two basic weaving techniques. The term "endless belt" as used herein refers to belts made by either method. In the first of these techniques, fabrics are flat woven by a flat weaving process, with their ends being joined to form an endless belt by any one of a number of well-known joining methods, such as dismantling and reweaving the ends together (commonly known as splicing), or sewing on a pin-seamable flap or a special foldback on each end, then reweaving these into pin-seamable loops. In the second basic weaving technique, fabrics are woven directly in the form of a continuous belt with an endless weaving process.

The weaving machine for endless weaving is differs significantly from a weave loom for flat weaving. For flat weaving the material (monofilament spools) is placed on both sides of the weave loom. A shuttle pulls the monofilament from one side to the other. For endless weaving the weft material is placed in the shuttle and is woven off the shuttle spool. When a shuttle spool is empty the yarn of the new shuttle spool is welded to the previous yarn. However, the complexity of the weaves possible with an endless weaving process is limited due to the formation and quality of the fabric at the loom edges.

Standard dryer fabrics are woven flat and need a joining process after the heat-setting to make them endless. It may be desirable to provide a dryer fabric that can be manufactured more easily.

SUMMARY

As a first aspect, embodiments of the invention are directed to a dryer fabric for a papermaking machine. The dryer fabric comprises: a plurality of upper warp yarns; a plurality of lower warp yarns; and a plurality of weft yarns interwoven with the plurality of upper and lower warp yarns in a series of repeat units. Each of the weft yarns includes upper and lower portions, the upper portions interwoven with the upper warp yarns, and the lower portions interwoven with the lower warp yarns. The upper portion of each weft yarn includes a first seam loop and the lower portion of each weft yarn includes a second seam loop. The first and second seam loops of the weft yarns are interdigitated to form a seam, the seam receiving a pintle so that the fabric forms an endless loop.

As a second aspect, embodiments of the invention are directed to a dryer fabric for a papermaking machine comprising: a plurality of upper warp yarns; a plurality of lower warp yarns; and a plurality of weft yarns interwoven with the plurality of upper and lower warp yarns in a series of repeat units. Each weft yarn includes upper and lower portions, the upper portions interwoven with the upper warp yarns, and the lower portions interwoven with the lower warp yarns. The upper portion of each weft yarn includes a first seam loop and the lower portion of each weft yarn includes a second seam loop. The first and second seam loops of the weft yarns are interdigitated to form a seam, the seam receiving a pintle so that the fabric forms an endless loop. First and second areas immediately adjacent the seam have a density that is no more than 10 percent greater than the density of the remainder of the fabric.

As a third aspect, embodiments of the invention are directed to a dryer fabric for a papermaking machine comprising: a plurality of upper warp yarns; a plurality of lower warp yarns; and a plurality of weft yarns interwoven with the plurality of upper and lower warp yarns in a series of repeat units. Each weft yarn includes upper and lower portions, the upper portions interwoven with the upper warp yarns, and the lower portions interwoven with the lower warp yarns. The upper portion of each weft yarn includes a first seam loop and the lower portion of each weft yarn includes a second seam loop. The first and second seam loops of the weft yarns are interdigitated to form a seam, the seam receiving a pintle so that the fabric forms an endless loop. The weft yarns comprise PET yarns and PPS yarns.

DETAILED DESCRIPTION

Figure 1:
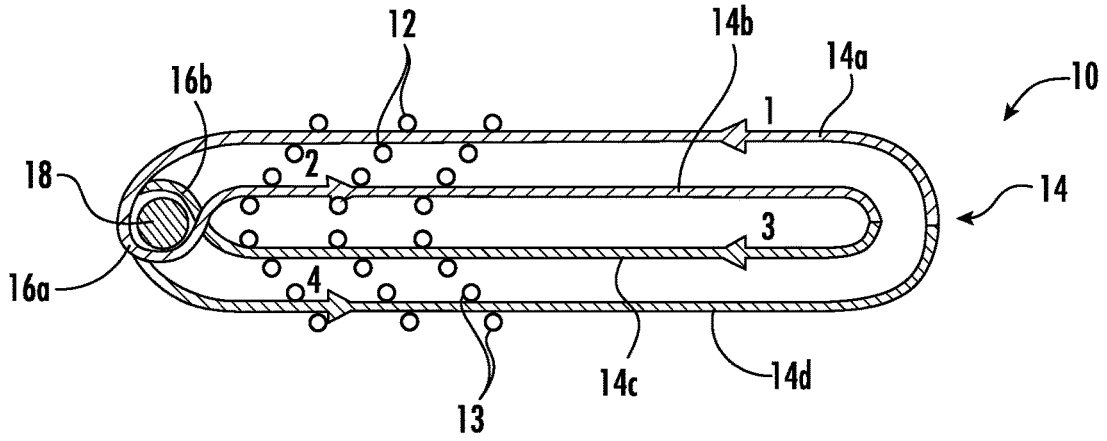
FIG. 1 is a schematic section view of an endless-woven dryer fabric according to embodiments of the invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

The present invention now will be described more fully hereinafter with reference to the accompanying drawings, in which illustrative embodiments of the invention are shown.

As used herein, the terms machine direction ("MD") and cross-machine direction ("CMD") refer, respectively, to a direction aligned with the direction of travel of the forming fabric on the papermaking machine, and a direction parallel to the fabric surface and traverse to the direction of travel. Likewise, directional references to the vertical relationship of the yarns in the fabric (e.g., above, below, top, bottom, beneath, etc.) assume that the paper making surface of the fabric is the top of the fabric and the machine side surface of the fabric is the bottom of the fabric.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper", "top", "middle", "bottom" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

It has been conceived that endless weaving of dryer fabrics may provide a number of advantages over flat-woven fabrics. The elimination of the joining step that is necessary for flat-woven fabrics can provide some of these advantages. The concept is described below.

FIG. 1 illustrates a schematic end view of the weaving process for a dryer fabric 10. The dryer fabric 10 includes a plurality of upper warp yarns 12 and lower weft yarns 13 (which are shown in FIG. 1 as circles that extend normal to the page in FIG. 1) and a plurality of weft yarns 14 (one of which is shown in FIG. 1). The upper and warp yarns 12, 13 and weft yarns 14 are shown as weaving in a pattern of repeat units. In the repeat units, four upper warp yarns 12 interweave with the upper portions 14*a*, 14*b* of the weft yarns 14 in a sequence in which each upper warp yarn 12 passes over the upper portions 14*a* of two paired weft yarns 14, then passes between the upper portions 14*a*, 14*b* of the next two paired weft yarns 14, then under the upper portions 14*b* of the next pair of weft yarns 14, then between the upper portions 14*a*, 14*b* of the next pair of weft yarns 14 before resuming the sequence with the next pair of weft yarns 14. Adjacent upper warp yarns 12 are offset from each other by one pair of weft yarns 14.

Similarly, the lower warp yarns 13 weave in a sequence with the lower portions 14*c*, 14*d* of the weft yarns 14 in which each lower warp yarn 13 passes over the lower portions 14*c* of two paired weft yarns 14, then passes between the lower portions 14*c*, 14*d* of the next two paired weft yarns 14, then under the lower portions 14*d* of the next pair of weft yarns 14, then between the lower portions 14*c*, 14*d* of the next pair of weft yarns 14 before resuming the sequence with the next pair of weft yarns 14. Adjacent lower warp yarns 13 are offset from each other by one pair of weft yarns 14.

It can also be seen in FIG. 1 that a single weft yarn 14 forms all of the upper portions 14*a*, 14*b* and lower portions 14*c*, 14*d*. More specifically, the beginning at the right side of FIG. 1, the upper portion 14*a* is formed as the weft yarn 14 is routed to the left, the upper portion 14*b* is formed as the weft yarn returns to the right, the lower portion 14*c* is formed as the weft yarn 14 is routed back to the left, and the lower portion 14*d* is formed as the weft yarn 14 returns to the right.

Importantly, as each weft yarn 14 transitions between the upper portion 14*a* and the upper portion 14*b*, the weft yarn 14 forms a seam loop 16*a* around and under a pintle 18. Similarly, as each weft yarn 14 transitions between the lower portion 14*c* and the lower portion 14*d*, the weft yarn 14 forms a seam loop 16*b* around and over the pintle 18. As they are formed, the seam loops 16*a*, 16*b* are interdigitated with each other. As a result, when weaving is complete, the result is an endless fabric 10 that is held together at its ends (defined by the seam loops 16*a*, 16*b*) by the pintle 18. The fabric 10 can be installed in the dryer section of a papermaking machine by removing the pintle 18 and replacing it in the interdigitated seam loops 16*a*, 16*b* with a smaller pintle 20 (shown below in FIG. 2) that more closely resembles the size of a warp yarn 12, so that the resulting seam 22 is formed.

Figure 2:
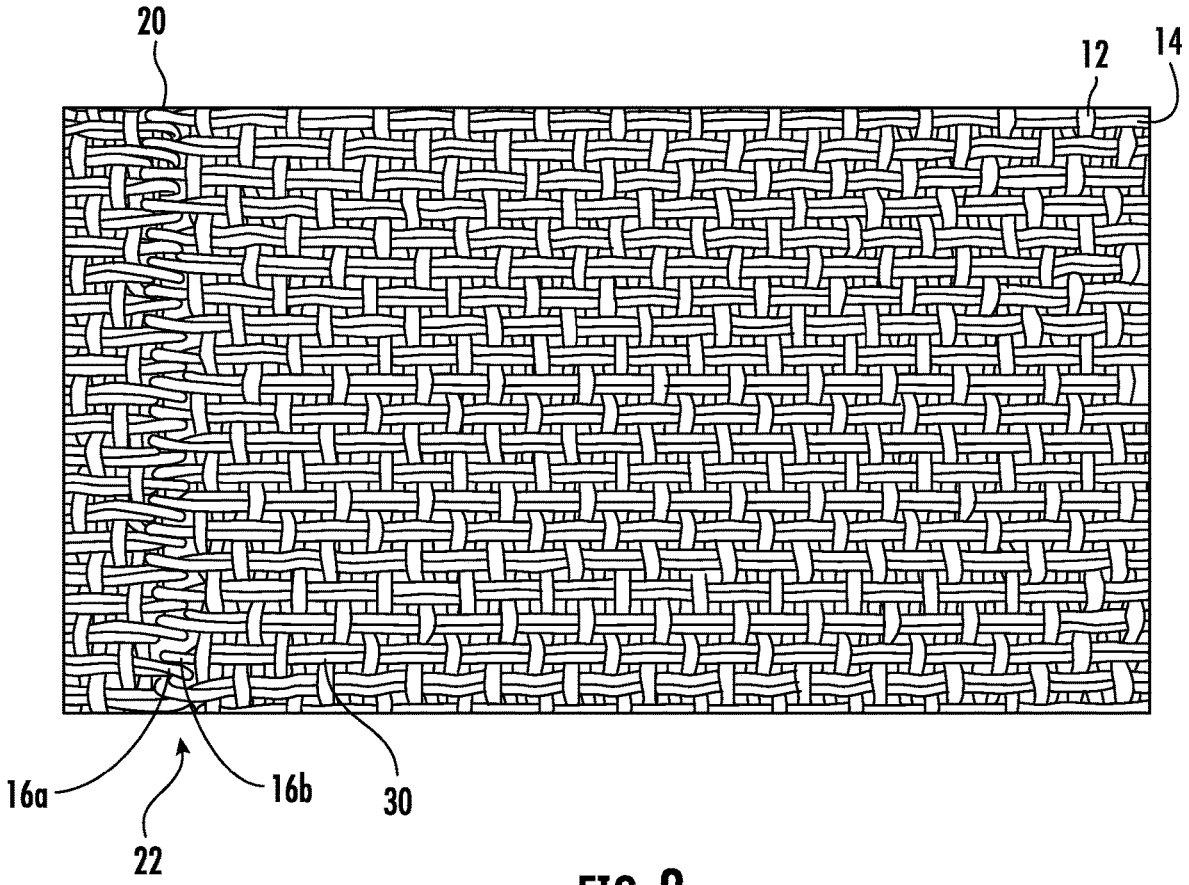
FIG. 2 is a top view of a portion of the dryer fabric of FIG. 1.
Figure 3:
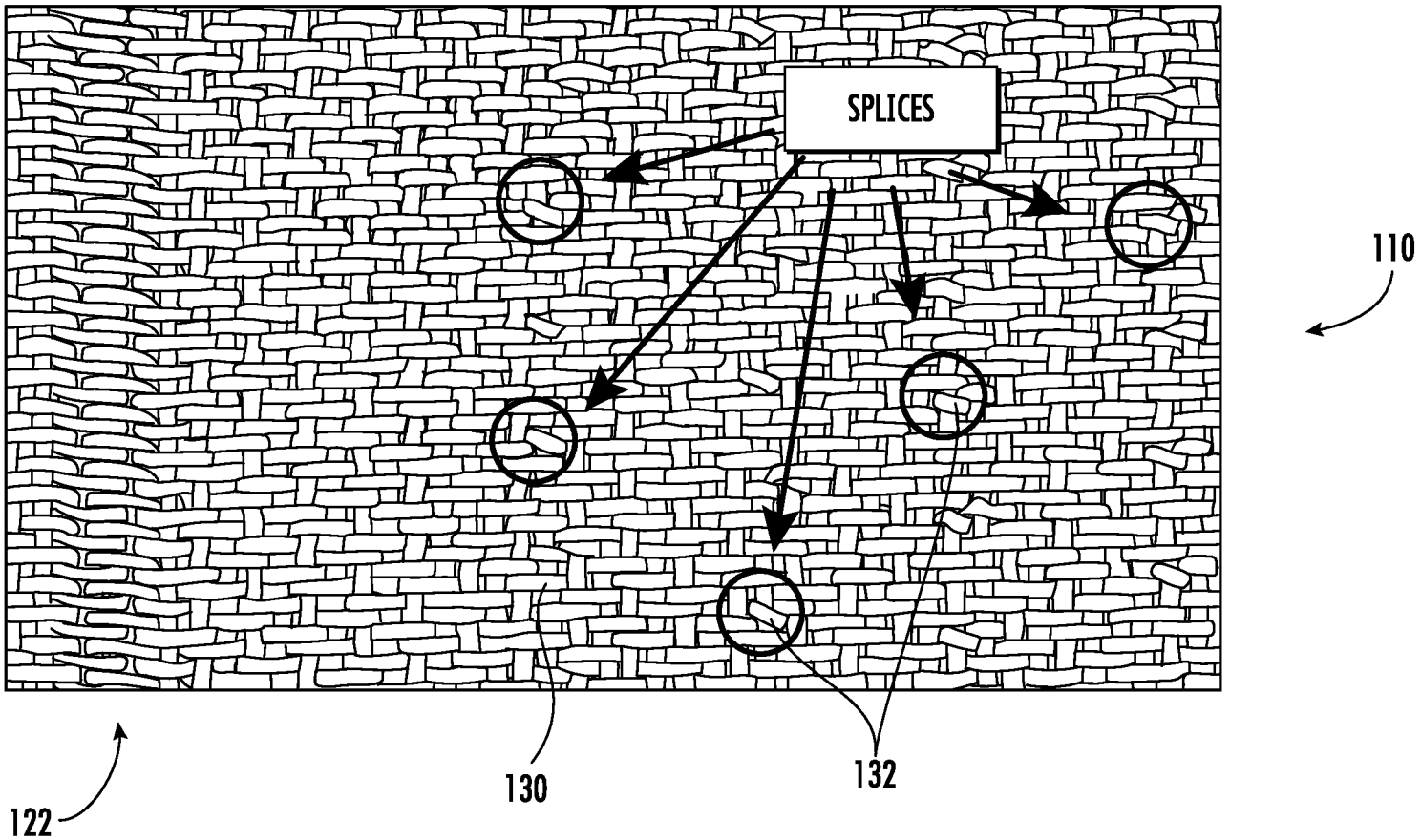
FIG. 3 is a top view of a portion of a prior dryer fabric showing splice locations adjacent the seam.
Figure 4:
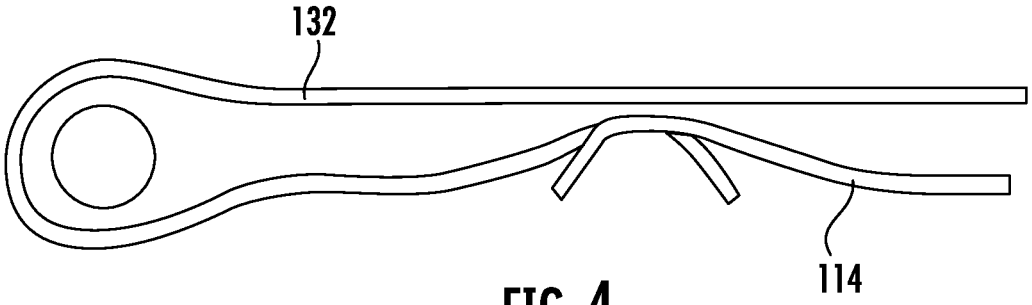
FIG. 4 is an enlarged schematic section view of a spliced weft yarn of a prior fabric.

The fabric 10 as shown in FIG. 2 can be favorably compared to a similar fabric 110 (which was flat-woven, rather than being endless woven) shown in FIG. 3. In FIG. 2, the area 30 that is adjacent the seam loops 16*a*, 16*b* is substantially uniform, and so matches the remainder of the fabric 10 with the exception of the seam 22 itself. In contrast, the flat-woven fabric 110 has in its area 130 adjacent the seam 122 multiple splices 132. These splices 132 are made necessary by the flat-weaving process. As shown in FIG. 4, each splice 132 has open ends, and is arranged adjacent the ends of weft yarns 114. This arrangement results in weaker overall seam strength, as nothing connects or anchors the splices 132 in place.

Figure 5:
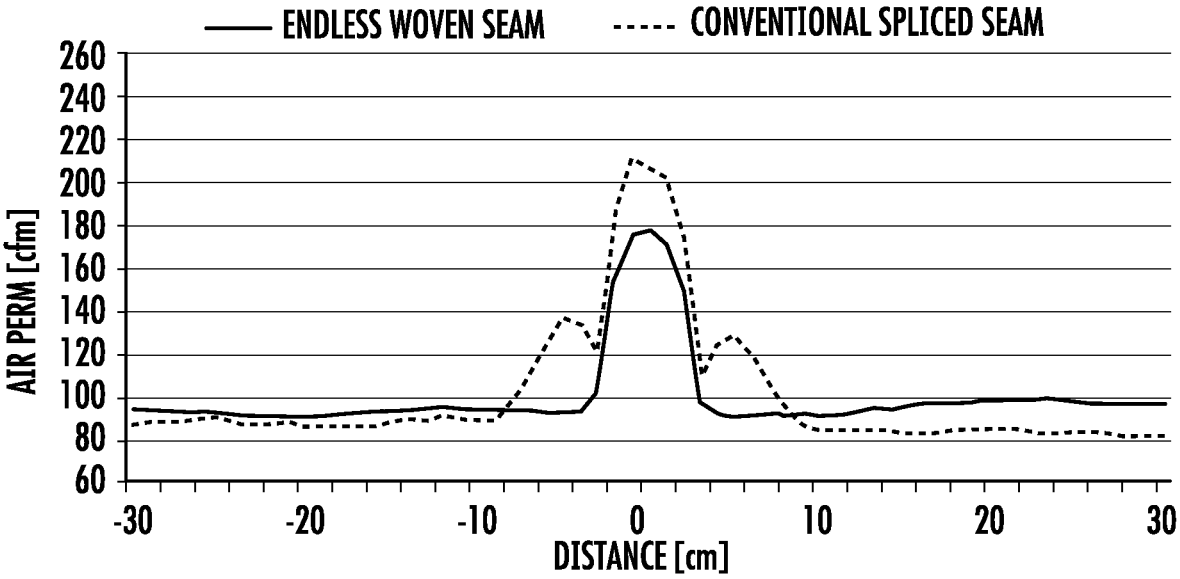
FIG. 5 is a graph plotting air permeability as a function of location for the dryer fabrics of FIG. 1 and FIG. 2 versus a conventional dryer fabric of FIG. 3.

Moreover, the locations where the splices 132 are side-by-side with weft yarns 114 are less dense with yarns than the remainder of the fabric 110. Such locations of reduced density are seen in FIG. 3. FIG. 5 shows a graph plotting the air permeability of the fabrics 10, 110 across the length of the fabrics. The highest peak of each plot (near the "0" of the horizontal axis) represents the seam 22, 122 itself. It can be seen that the areas adjacent the seams 22, 122 (which represent areas 30, 130 in the fabrics 10, 110) are markedly different, with these areas 30 of the fabric 10 resembling the remainder of the fabric 10, whereas the areas 130 of the fabric 110 have lower density (and thus higher air permeability) than the remainder of the fabric 110 due to the increased pore size caused by the splice ends. The increased uniformity of the fabric 10 can improve performance of the overall fabric. As a specific example, the area adjacent the seam (e.g., about 2 cm from the seam) may have an increased density compared to the remainder of the fabric of no more than about 10 percent.

In addition to the performance advantages discussed above, the use of an endless-woven fabric also carries the advantage of eliminating the joining/splicing process, which is typically time- and labor-intensive, and therefore adds expense to the fabric 110 by comparison.

As another potential advantage, the fabric 10 can be woven nearly to the specifications of the weaving machine. In contrast, flat woven dryer fabrics are typically woven in big pieces (as stock cloth) and heat set. After heat-setting, individual pieces are cut out of the stock cloth. This practice always leads to not unusable scraps that are too small for additional customer fabrics. The waste percentage with stock cloth production of dryer fabrics is ordinarily around 30-40%.

Further, if needed multiple endless-woven fabrics can be woven and joined end-to-end to form an endless fabric that is the combination of two, three or more individual endless-woven fabrics. This is a much simpler product to manufacture than one that would require the use of multiple flat-woven fabrics.

Finally, endless-woven fabrics may include multiple yarn types. For example, a fabric may be constructed that is predominantly polyethylene terephthalate (PET) yarns, but that includes polyphenylene sulfide (PPS) yarns near the edges for stiffness. This flexibility of yarn type is not afforded by producing a large stock cloth from which dryer fabrics are cut.

Those of skill in this art will appreciate that dryer fabrics according to embodiments of the present invention may take other forms. For example, different weave patterns than those described may be employed. Similarly, different yarn types than those described may be employed. Other variations may be apparent to those of skill in this art.

The warp yarns may be formed of PET, and/or may range from about 0.50 to 1.0 mm in diameter. The weft yarns may be formed of PET, and/or may range from 0.30 to 0.70 mm in diameter. The mesh of the fabric may be between about 25 to 60 ppi (weft)×15 to 30 ppi (warp).

As a specific example, the fabric 10 described above may have the characteristics set forth in Table 1.

TABLE 1

| Yarn Type | Yarn Size (denier) | Yarn Material |
|---|---|---|
| Warp yarns | 0.80 mm | PET |
| Weft yarns | 0.50 mm | PET |
| Mesh | 40 ppi (weft) × 21 ppi (warp) | |

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A combination, comprising:

(a) a papermaking machine having forming, press and dryer sections; and (b) a dryer fabric comprising:

a plurality of upper warp yarns;

a plurality of lower warp yarns; and a plurality of weft yarns interwoven with the plurality of upper and lower warp yarns in a series of repeat units;

wherein each weft yarn includes upper and lower portions, the upper portions interwoven with the upper warp yarns, and the lower portions interwoven with the lower warp yarns;

wherein the upper portions of each weft yarn include first and second upper portions that interweave with each upper warp yarn, and wherein the lower portions of each weft yarn include first and second lower portions that interweave with each lower warp yarn;

wherein the upper portion of each weft yarn includes a first seam loop and the lower portion of each weft yarn includes a second seam loop;

wherein the first and second seam loops of the weft yarns are interdigitated to form a seam, the seam receiving a pintle so that the fabric forms an endless loop;

wherein the dryer fabric is installed in the dryer section of the papermaking machine.

2. The combination defined in claim 1, wherein first and second areas immediately adjacent the seam are devoid of splices between the first and second seam loops and the warp yarns.

3. The combination defined in claim 2, wherein the first and second areas have a density that is no more than 10 percent greater than the density of the remainder of the fabric.

4. The combination defined in claim 1, wherein the weft yarns comprise PET yarns.

5. The combination defined in claim 4, wherein the weft yarns further comprise PPS yarns.

6. A combination, comprising:

(a) a papermaking machine having forming, press and dryer sections; and (b) an endless-woven dryer fabric for a papermaking machine, comprising:

a plurality of upper warp yarns;

a plurality of lower warp yarns; and a plurality of weft yarns interwoven with the plurality of upper and lower warp yarns in a series of repeat units;

wherein each weft yarn includes upper and lower portions, the upper portions interwoven with the upper warp yarns, and the lower portions interwoven with the lower warp yarns;

wherein the upper portions of each weft yarn include first and second upper portions that interweave with each upper warp yarn, and wherein the lower portions of each weft yarn include first and second lower portions that interweave with each lower warp yarn;

wherein the upper portion of each weft yarn includes a first seam loop and the lower portion of each weft yarn includes a second seam loop;

wherein the first and second seam loops of the weft yarns are interdigitated to form a seam, the seam receiving a pintle so that the fabric forms an endless loop;

wherein first and second areas immediately adjacent the seam have a density that is no more than 10 percent greater than the density of the remainder of the fabric; and wherein the endless-woven dryer fabric is installed in the dryer section of the papermaking machine.

7. The combination defined in claim 6, wherein the weft yarns comprise PET yarns.

8. The combination defined in claim 7, wherein the weft yarns further comprise PPS yarns.

9. An endless-woven dryer fabric for a papermaking machine, comprising:

a plurality of upper warp yarns;

a plurality of lower warp yarns; and a plurality of weft yarns interwoven with the plurality of upper and lower warp yarns in a series of repeat units;

wherein each weft yarn includes upper and lower portions, the upper portions interwoven with the upper warp yarns, and the lower portions interwoven with the lower warp yarns;

wherein the upper portions of each weft yarn include first and second upper portions that interweave with each upper warp yarn, and wherein the lower portions of each weft yarn include first and second lower portions that interweave with each lower warp yarn;

wherein the upper portion of each weft yarn includes a first seam loop and the lower portion of each weft yarn includes a second seam loop;

wherein the first and second seam loops of the weft yarns are interdigitated to form a seam, the seam receiving a pintle so that the fabric forms an endless loop; and wherein the weft yarns comprise PET yarns and PPS yarns, and wherein each of the PPS weft yarns is located near an edge of the endless loop.

10. The dryer fabric defined in claim 9, wherein first and second areas immediately adjacent the seam are devoid of splices between the first and second seam loops and the warp yarns.

11. The dryer fabric defined in claim 10, wherein the first and second areas have a density that is no more than 10 percent greater than the density of the remainder of the fabric.

* * * * *